US006915840B2

(12) United States Patent
Devine, II et al.

(10) Patent No.: US 6,915,840 B2
(45) Date of Patent: Jul. 12, 2005

(54) METHODS AND APPARATUS FOR FABRICATING TURBINE ENGINE AIRFOILS

(75) Inventors: Robert Henry Devine, II, Kingwood, TX (US); Larry Duane Brown, Greer, SC (US); Robert Alan Brittingham, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/322,124

(22) Filed: Dec. 17, 2002

(65) Prior Publication Data

US 2004/0112564 A1 Jun. 17, 2004

(51) Int. Cl.[7] ..... B22C 9/00

(52) U.S. Cl. ..... 164/516; 164/340; 164/369; 164/397; 164/137

(58) Field of Search ..... 164/516, 340, 164/369, 397, 137

(56) References Cited

U.S. PATENT DOCUMENTS

| | | | | |
|---|---|---|---|---|
| 3,596,703 A | | 8/1971 | Bishop et al. | |
| 3,659,645 A | | 5/1972 | Rose | |
| 4,487,246 A | | 12/1984 | Frasier | |
| 4,512,385 A | * | 4/1985 | Uppgren | 164/364 |
| 5,050,665 A | | 9/1991 | Judd | |
| 5,296,308 A | | 3/1994 | Caccavale et al. | |
| 5,394,932 A | | 3/1995 | Carozza et al. | |
| 5,547,629 A | | 8/1996 | Diesen et al. | |
| 5,558,152 A | * | 9/1996 | Anderson | 164/340 |
| 5,599,166 A | * | 2/1997 | Deptowicz et al. | 416/97 R |
| 6,062,817 A | | 5/2000 | Danowski et al. | |
| 6,068,806 A | | 5/2000 | Dietrich | |
| 6,315,941 B1 | | 11/2001 | Keller et al. | |

* cited by examiner

*Primary Examiner*—Jonathan Johnson
*Assistant Examiner*—I.-H. Lin
(74) *Attorney, Agent, or Firm*—Armstrong Teasdale LLP

(57) ABSTRACT

A method for casting an airfoil for a turbine engine is provided. The method includes forming a casting core to define a hollow portion in the airfoil and forming a print out region at one end of the casting core. The method also includes coupling the casting core to the print out region with at least one frusto-conical member to facilitate structurally supporting the casting core.

19 Claims, 3 Drawing Sheets

METHODS AND APPARATUS FOR FABRICATING TURBINE ENGINE AIRFOILS

BACKGROUND OF THE INVENTION

This invention relates generally to turbine engines, and more specifically to turbine blades used with turbine engines.

At least some known turbine engines include a turbine that includes a plurality of rotor blades that extract rotational energy from fluid flow entering the turbine. Because the turbine is subjected to high temperatures, turbine components are cooled to reduce thermal stresses that may be induced by the high temperatures. Accordingly, at least some known rotating blades include hollow airfoils that are supplied cooling air through cooling circuits defined within the airfoil. More specifically, the airfoils include a cooling cavity bounded by sidewalls that define the cooling cavity.

To fabricate the cooling passages, at least some known turbine blades are cast using an internal core that forms the internal cooling passageways within the blades. Because of the relative large size of blades and/or vanes that may be used within industrial turbine engines, at least some known cores are reinforced to enable the core to withstand the injection pressures of the wax and the subsequent casting process. More specifically, a tip of at least some known casting cores is supported during the casting process by at least one rod that has a substantially constant diameter along its length.

When the casting process is complete, a print out coupled between the rod and the core is removed. An opening created by the rod may provide a channel for cooling the tip cap portion of the blade. In some known blade designs, the opening is sealed to facilitate cooling other portions of the blade. In such cases, the openings are sealed using known sealing techniques, such as welding or brazing. To facilitate forming a smaller diameter opening, some known castings use rods that have a diameter less than approximately 0.035 inches. However, as an overall size and/or weight of the casting is increased, a smaller diameter rod may not provide enough structural support to the core.

BRIEF SUMMARY OF THE INVENTION

In one aspect of the invention, a method for casting an airfoil for a turbine engine is provided. The method includes forming a casting core to define a hollow portion in the airfoil and forming a print out region at one end of the casting core. The method also includes coupling the casting core to the print out region with at least one frusto-conical member to facilitate structurally supporting the casting core.

In another aspect, an airfoil casting core for a turbine blade is provided. The casting core includes at least one of a leading edge path region, a center path region, and a trailing edge path region. The casting core also includes a core print region coupled to at least one of a leading edge path region, a center path region, and a trailing edge path region by at least one frusto-conical member.

In a further aspect of the invention, an airfoil core for use in casting an airfoil is provided. The airfoil core includes at least one of a leading edge path region, a center path region, and a trailing edge path region, extending between a core tip and a core root. The airfoil core also includes a print out region coupled to at least one of the core tip and the core root by at least one frusto-conical rod.

DETAILED DESCRIPTION OF THE INVENTION

Figure 1:
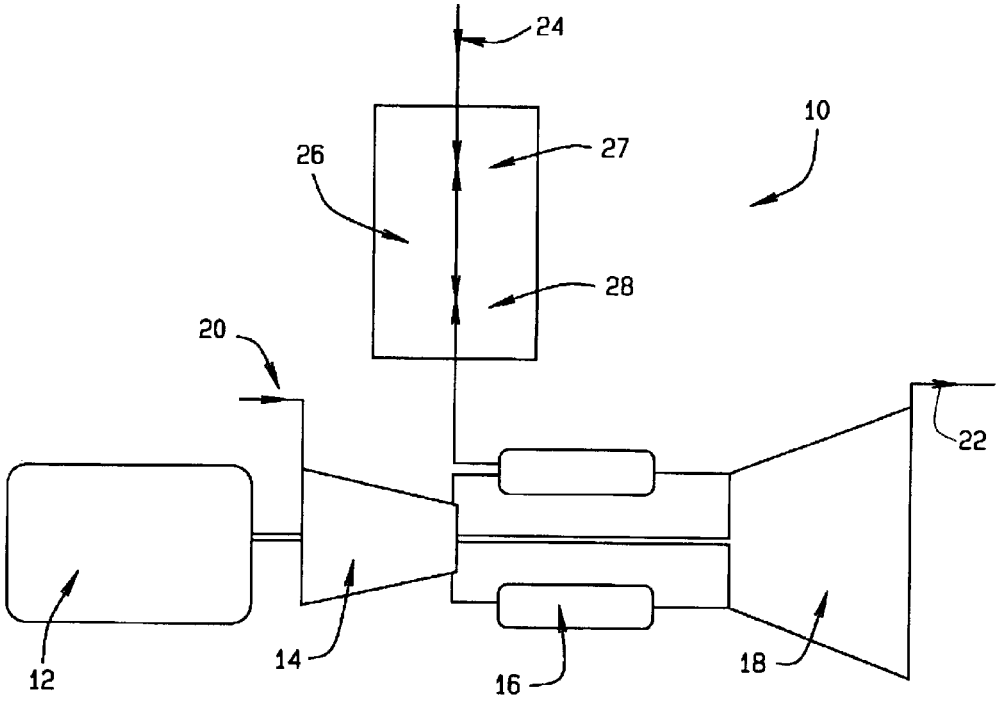
FIG. 1 is a perspective partial cut away view of an exemplary turbine.

FIG. 1 is a schematic illustration of a gas turbine engine 10 including a generator 12, a compressor 14, a combustor 16 and a turbine 18. Engine 10 has an inlet or upstream side 20, an exhaust or downstream side 22, and a gas fuel inlet 24. The gas fuel passes through a gas control module 26 containing an isolation valve 27, known as the stop-ratio valve (SRV) and a gas control valve (GCV) 28. In one embodiment, engine 10 is a turbine engine commercially available from General Electric Power Systems, Schenectady, N.Y.

In operation, highly compressed air is delivered from compressor 14 to combustor 16. Gas fuel is delivered to the combustor 16 through a plurality of fuel nozzles (not shown in FIG. 1) and hot exhaust gas from combustor 16 is discharged through a turbine nozzle assembly (not shown in FIG. 1) and is used to drive turbine 18. Turbine 18, in turn, drives compressor 14 and generator 12.

Figure 2:
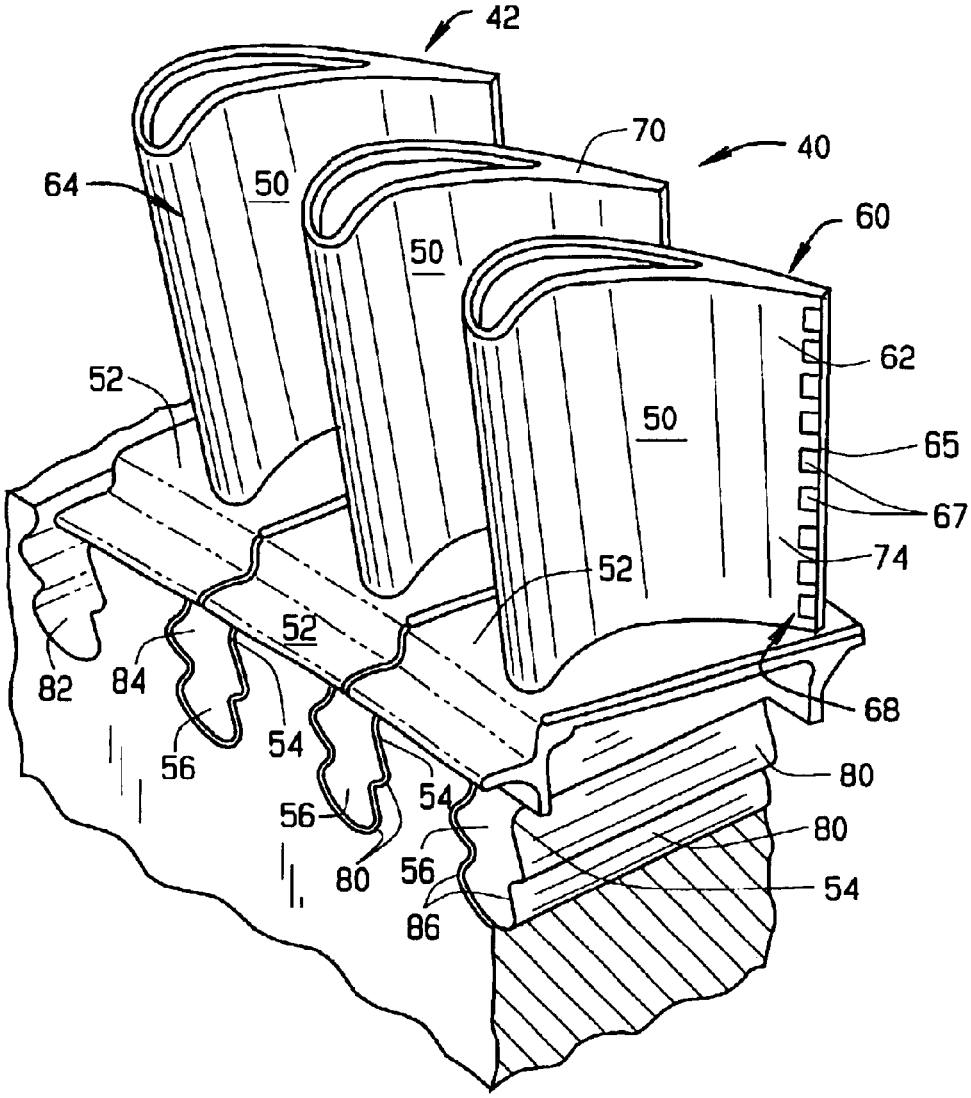
FIG. 2 is a partial perspective view of an exemplary rotor assembly that may be used with the turbine shown in FIG. 1.

FIG. 2 is a perspective view of a rotor assembly 40 that may be used with a turbine, such as turbine engine 10 (shown in FIG. 1). Assembly 40 includes a plurality of rotor buckets or blades 42 mounted to rotor disk 44. In one embodiment, blades 42 form a high-pressure turbine rotor blade stage (not shown) of turbine engine 10.

Rotor blades 42 extend radially outward from rotor disk 44, and each blade 42 includes an airfoil 50, a platform 52, a shank 54, and a dovetail 56. Each airfoil 50 includes first sidewall 60 and a second sidewall 62. First sidewall 60 is convex and defines a suction side of airfoil 50, and second sidewall 62 is concave and defines a pressure side of airfoil 50. Sidewalls 60 and 62 are joined at a leading edge 64 and at an axially-spaced trailing edge 65 of airfoil 50. More specifically, airfoil trailing edge 65 is spaced chord-wise and downstream from airfoil leading edge 64. A plurality of trailing edge slots 67 are formed in airfoil 50 to discharge cooling air over trailing edge 65. The cooling air facilitates reducing the temperatures, thermal stresses, and strains experienced by trailing edge 65.

First and second sidewalls 60 and 62, respectively, extend longitudinally or radially outward in span from a blade root 68 positioned adjacent platform 52, to an airfoil tip cap 70. Airfoil tip cap 70 defines a radially outer boundary of an internal cooling chamber (not shown in FIG. 2). The cooling chamber is bounded within airfoil 50 between sidewalls 60 and 62, and extends through platform 52 and through shank 54 and into dovetail 56. More specifically, airfoil 50 includes an inner surface (not shown in FIG. 2) and an outer surface 74, and the cooling chamber is defined by the airfoil inner surface.

Platform 52 extends between airfoil 50 and shank 54 such that each airfoil 50 extends radially outward from each respective platform 52. Shank 54 extends radially inwardly from platform 52 to dovetail 56. Dovetail 56 extends radially inwardly from shank 54 and facilitates securing rotor blade 42 to rotor disk 44. More specifically, each dovetail 56 includes at least one tang 80 that extends radially outwardly from dovetail 56 and facilitates mounting each dovetail 56 in a respective dovetail slot 82. In the exemplary embodiment, dovetail 56 includes an upper pair of blade tangs 84, and a lower pair of blade tangs 86.

Figure 3:
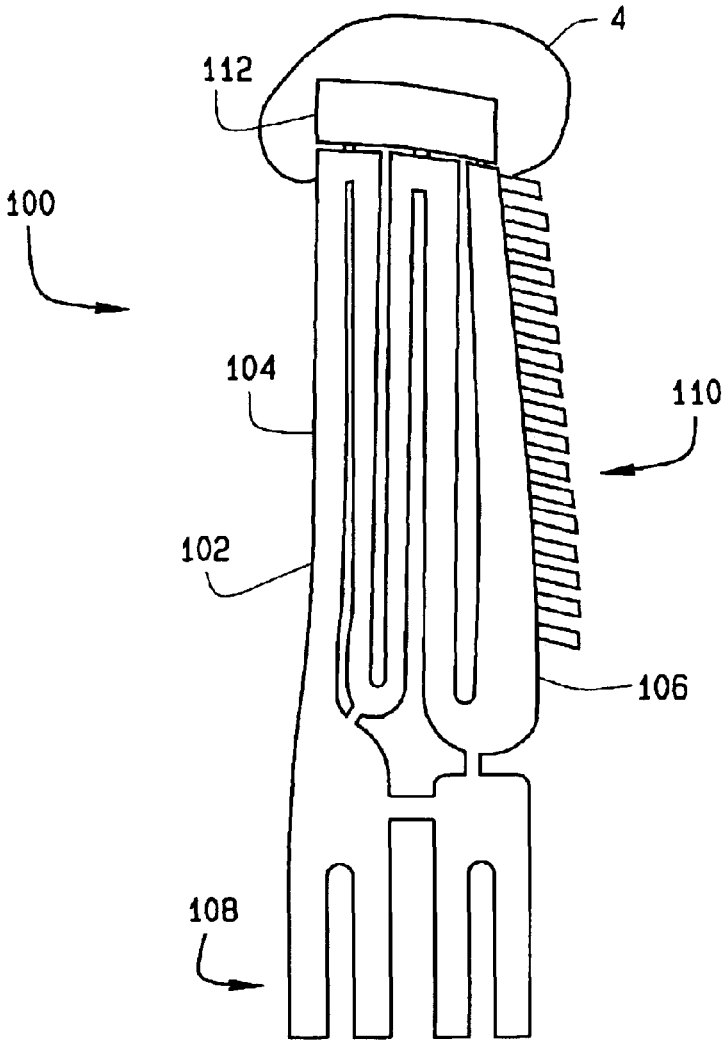
FIG. 3 is a perspective view of an exemplary airfoil core that may be used to fabricate an airfoil used with the rotor assembly shown in FIG. 2.
Figure 4:
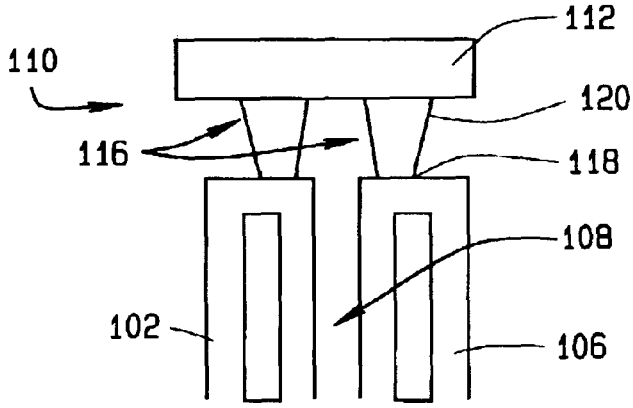
FIG. 4 is an enlarged schematic view of a portion of the airfoil core shown in FIG. 3 and taken along area 4.

FIG. 3 shows an exemplary airfoil core 100 used in fabricating turbine blades 42 (shown in FIG. 2). FIG. 4 is an enlarged schematic view of a portion of airfoil core 100 taken along area 4 (shown in FIG. 3). In one embodiment, core 100 is used to fabricate Stage 2 Bucket castings. Airfoil core 100 includes a leading edge path 102, a center path 104, a trailing edge path 106, and a root cooling path 108. Trailing edge path 106 has a plurality of fingers 110 extending from trailing edge path 106.

During casting, leading edge path 102 and center path 104 form a first cooling passage (not shown), and a second cooling passage (not shown), respectively, in the resulting airfoil. Trailing edge path 106 forms a third cooling passage (not shown), and fingers 108 extending from trailing edge path 106, form a plurality of trailing edge slots, such as slots 67 (shown in FIG. 2). In one embodiment, at least one of leading edge path 102, center path 104, and trailing edge path 106 includes an extension that forms a recess in the resulting airfoil cooling chamber. Thus, after a cooling passage is formed, the recess facilitates controlling airflow within the cooling cavity by forming an air flow restriction in the cooling chamber.

Airfoil core 100 also includes at least one "print out" region that facilitates handling of core 100. More specifically, in the exemplary embodiment, airfoil core 100 includes a core tip print out region 112. Core tip print out region 112 is coupled to at least one of leading edge path 102, center path 104, and trailing edge path 106 by at least one member 116. First member 116 includes a first end 118 and a second end 120. Specifically, first end 118 is coupled to at least one of leading edge path 102, center path 104, and trailing edge path 106 and second end 120 is coupled to core tip print out region 112. Alternatively, core tip print out region 112 is coupled to root cooling path 108 by at least one member 116.

Member 116 is frusto-conical and has a first end 118 that has a smaller diameter $d_1$ than a diameter $d_2$ at a second end 120. Frusto-conical rod 116 reduces the area of weak mechanical strength in the regions of airfoil core 100 which exhibit break potential and subsequent loss of the casting. In another embodiment, member 116 can have any cross-sectional shape, such as a substantially square or triangular shape, with first end 118 having a smaller cross-sectional dimension than second end 120.

Airfoil core 100 is fabricated by injecting a liquid ceramic and graphite slurry into core die (not shown). The slurry is heated to form a solid ceramic airfoil core 100. The airfoil core 100 is suspended by core print out 112 in an airfoil die (not shown) and hot wax is injected into the airfoil die to surround the ceramic airfoil core. The hot wax solidifies and forms an airfoil (not shown in FIG. 1) with the ceramic core suspended in the airfoil.

The wax airfoil with the ceramic core is then coated with multiple layers of ceramic and heated to remove the wax, thus forming a cavity shell having the shape of the airfoil. The shell is then cured in a heated furnace. Molten metal is then poured into the shell and thus forming a metal airfoil with the ceramic core remaining in place. The airfoil is then cooled, and the ceramic core is removed from the solidified casting by leaching or other means, leaving a casting having a hollow interior corresponding to the configuration of the airfoil core 100.

The above-described airfoil core is cost-effective and highly reliable. The airfoil core includes at least one conical rod for attaching a core print out to the airfoil core. An area/diameter of the rods increases from the first end to the second end adding mechanical strength in regions of the airfoil core which exhibit break potential and subsequent loss of the casting. Additionally, the increased strength of the conical rod enables the conical rod to suspend a larger airfoil core. As a result, the geometry design of the conical rod, allows for the expansion of as cast feature geometry into the original casting design with an acceptable approach for manufacturing introduction, the conical rod facilitates maintaining material fatigue life and extending a useful life of the airfoil core during the casting process in a cost-effective and reliable manner.

Exemplary embodiments of airfoil casting cores are described above in detail. The systems are not limited to the specific embodiments described herein, but rather, components of each assembly may be utilized independently and separately from other components described herein. Each airfoil casting core component can also be used in combination with other airfoil casting cores and turbine components.

While the invention has been described in terms of various specific embodiments, those skilled in the art will recognize that the invention can be practiced with modification within the spirit and scope of the claims.

What is claimed is:

1. A method for casting an airfoil for a turbine engine, said method comprising:

forming a casting core to define a hollow portion in the airfoil;

forming a print out region at one end of the casting core; and coupling the casting core to the print out region with at least one frusto-conical member that includes a first end having a first diameter, a second end having a second diameter, and a frusto-conically shaped sidewall extending continuously between the first end and the second end, the first diameter being different than the second diameter, and wherein the first end is coupled to the casting core, the second end is coupled to the print out region, and the frusto-conical member is configured to facilitate structurally supporting the casting core.

2. A method according to claim 1 wherein said forming a casting core comprises forming a casting core from a ceramic material.

3. A method according to claim 1 wherein said forming a casting core further comprises forming a casting core to form at least one of a leading edge path, a center path, and a trailing edge path within the airfoil.

4. A method according to claim 3 wherein said coupling the casting core further comprises coupling at least one frusto-conical rod to the print out region such that a first end of the frusto-conical rod is coupled to at least one of the leading edge path, the center path, and the trailing edge path, and a second end of the frusto-conical rod is coupled to the print out region.

5. A method according to claim 4 further comprises forming the first end to have a first diameter and the second end to have a second diameter wherein the first diameter is smaller than the second diameter.

6. An airfoil casting core for a turbine blade, said casting core comprising:

at least one of a leading edge path region, a center path region, and a trailing edge path region; and a core print region attached to at least one of said leading edge path region, said center path region, and said trailing edge path region by at least one frusto-conical member comprising a first end having a first diameter, a second end having a second diameter, and a frusto-conically shaped sidewall extending continuously between the first end and the second end, said first diameter being different than said second diameter, said first end coupled to the casting core, said second end coupled to the print out region, such that said frusto-conical member facilitates structurally supporting the casting core.

7. An airfoil casting core according to claim 6 wherein said casting core comprises ceramic material.

8. An airfoil casting core according to claim 6 wherein at least one of said leading edge path region, said center path region, and said trailing edge path region defines a cooling chamber within said turbine blade.

9. An airfoil casting core according to claim 6 wherein said trailing edge path region comprises a plurality of fingers extending therefrom.

10. An airfoil casting core according to claim 9 wherein said plurality of fingers define a plurality of traveling edge slots within said blade.

11. An airfoil core according to claim 6 wherein said at least one frusto-conical member comprises a first end coupled to at least one of said leading edge path region, said center path region, and said trailing edge path region and a second end coupled to said print out region.

12. An airfoil core according to claim 11 wherein said first end has a first diameter smaller than a second diameter of said second end.

13. An airfoil core for casting an airfoil, said casting core comprising:

at least one of a leading edge path region, a center path region, and a trailing edge path region extending between a core tip and a core root; and a print out region attached to at least one of said core tip and said core root by at least one frusto-conical rod comprising a first end having a first diameter, a second end having a second diameter, and a frusto-conically shaped sidewall extending continuously between the first end and the second end, said first diameter being different than said second diameter, said first end coupled to the casting core, said second end coupled to the print out region, such that said frusto-conical member facilitates structurally supporting the casting core.

14. An airfoil core according to claim 13 wherein said casting core comprises ceramic material.

15. An airfoil core according to claim 13 wherein at least one of said leading edge path region, said center path region, and said trailing edge path region defines a cooling chamber within said airfoil.

16. An airfoil core according to claim 13 wherein said trailing edge path region comprises a plurality of fingers extending therefrom.

17. An airfoil core according to claim 16 wherein said plurality of fingers define a plurality of traveling edge slots within said airfoil.

18. An airfoil core according to claim 13 wherein said at least one frusto-conical rod comprises a first end coupled to at least one of said leading edge path region, said center path region, and said trailing edge path region and a second end coupled to said print out region.

19. An airfoil core according to claim 18 wherein said first end has a first diameter smaller than a second diameter of said second end.

* * * * *

UNITED STATES PATENT AND TRADEMARK OFFICE

CERTIFICATE OF CORRECTION

PATENT NO. : 6,915,840 B2
APPLICATION NO. : 10/322124
DATED : July 12, 2005
INVENTOR(S) : Devine, II et al.

It is certified that error appears in the above-identified patent and that said Letters Patent is hereby corrected as shown below:

In Claim 10, column 5, line 24, between “said” and “blade” insert -- turbine --.

Signed and Sealed this

Sixth Day of November, 2007

JON W. DUDAS
*Director of the United States Patent and Trademark Office*